United States Patent [19]

Glassman

[11] 4,420,894

[45] Dec. 20, 1983

[54] SNAP SHOE

[76] Inventor: Joel Glassman, 500 Bowling Ave., Nashville, Tenn. 37205

[21] Appl. No.: 369,653

[22] Filed: Apr. 19, 1982

[51] Int. Cl.[3] ..... A43B 13/28; A43B 13/42; A43B 23/00

[52] U.S. Cl. ..... 36/12; 36/107; 36/76 C

[58] Field of Search ..... 36/14, 15, 76 R, 76 C, 36/107, 108, 12, 43

[56] References Cited

U.S. PATENT DOCUMENTS

| | | | |
|---|---|---|---|
| 294,174 | 2/1884 | Williams | 36/14 |
| 376,411 | 1/1888 | Lion et al. | 12/142 B |
| 536,292 | 3/1895 | Pickering | 36/14 |
| 1,039,518 | 9/1912 | Golden | 36/108 |
| 1,206,749 | 11/1916 | Burnham | 36/14 |
| 1,907,997 | 5/1933 | Nickerson | 36/76 R |
| 2,046,732 | 7/1936 | Fein | 36/43 |
| 2,073,025 | 3/1937 | Prue | 36/76 |
| 2,128,134 | 8/1938 | Guisto | 36/7.5 |
| 2,183,277 | 12/1939 | Heilhecker | 36/14 |
| 2,340,582 | 2/1944 | Cushman | 12/142 |
| 2,368,314 | 1/1945 | Marx | 36/15 |
| 2,383,052 | 8/1945 | Everston | 36/19.5 |
| 2,426,666 | 9/1947 | Brophy | 36/12 |
| 2,482,333 | 9/1949 | Everston | 36/43 |
| 2,495,984 | 1/1950 | Roy | 36/15 |
| 2,651,117 | 9/1953 | Harris | 36/2.5 |
| 2,933,830 | 4/1960 | Bartels et al. | 36/2.5 |
| 3,538,628 | 11/1970 | Einstein, Jr. | 36/15 |

FOREIGN PATENT DOCUMENTS

| | | | |
|---|---|---|---|
| 1092165 | 4/1955 | France | 16/4 |
| 1165852 | 10/1958 | France . | |

*Primary Examiner*—Louis Rimrodt
*Assistant Examiner*—Steven N. Meyers
*Attorney, Agent, or Firm*—Gregory A. Madera

[57] ABSTRACT

A shoe having an insole with an upper and an outsole, the insole and outsole permanently fixed together by attaching members extending from the insole, which members are retained in corresponding receiving sockets in the outsole.

1 Claim, 7 Drawing Figures

SNAP SHOE

FIELD OF THE INVENTION

This invention relates to shoes, particularly to a means for easily and permanently fastening an insole to an outsole.

BACKGROUND OF THE INVENTION

One of the major cost factors in the manufacturing of footwear is the assembly of the principal components into a finished shoe. A particularly time-consuming and thus costly step in the prior art involves attaching an insole, on which the foot will rest when it is inside the shoe, to an outsole, which actually contacts the ground.

In the prior art, an upper portion of the shoe is sewn to an insole, which must be carefully cut and trimmed. The insole is then aligned with a similarly cut and trimmed outsole and sewn thereto. The sewing is done by stitching around the entire edge of the two parts so that they are fastened together. The stitching must be done very tightly so as to prevent moisture from entering in between the insole and the outsole, and accordingly, it is either a very time consuming operation or it requires expensive machinery.

SUMMARY OF THE INVENTION

I have discovered that a shoe can be easily and inexpensively made by using a pre-formed, flexible insole with a plurality of male snap elements on its underside, which snap elements are received and permanently held by a corresponding plurality of female snap indentations on the topside of a pre-formed outsole so that the two elements can be quickly aligned and fastened permanently together.

In the preferred embodiment, the flexible insole is molded of plastic in the desired shape, and it has a central opening. Snap elements, which are domed-shaped, are disposed around the underside of the insole. A leather upper is stitched to the insole, and the snap elements are aligned with the corresponding domed-shaped indentations in a pre-molded outsole. Adhesive is placed between the insole and the outsole and the snap elements are inserted into the indentations and permanently held therein. A cushioning shank insert is attached in a similar fashion inside the shoe to the top of the outsole exposed through the central opening in the insole. The shoe is then subjected to high temperature to cure the adhesive.

In another embodiment of this invention, the snap elements are latching hooks which are received by eyeholes in an outsole.

DESCRIPTION OF THE PREFERRED EMBODIMENT

The structure and operation of a preferred embodiment of the invention will now be described, after first describing the drawings.

DRAWINGS

STRUCTURE

Figure 1:
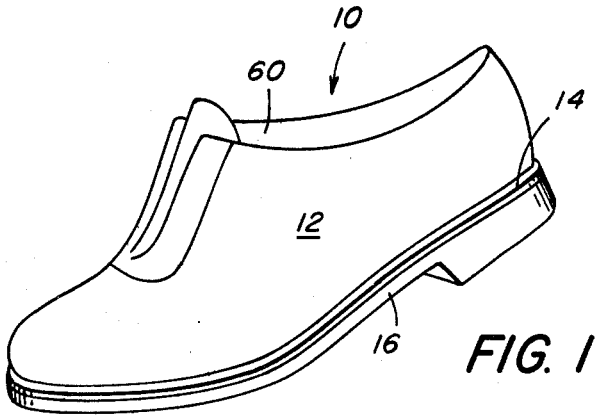
FIG. 1 is a perspective view of a completed shoe according to the invention herein.

Referring to FIG. 1, an assembled shoe is shown at 10. Shoe 10 generally comprises an upper 12, an insole 14 and an outsole 16. Upper 12 is made of leather or similar material. Insole 14 is molded of a light-weight, flexible material having good elastic memory such as plastic, and the outsole 16 is of a resilient, wear-resistant material such as rubber.

Figure 2:
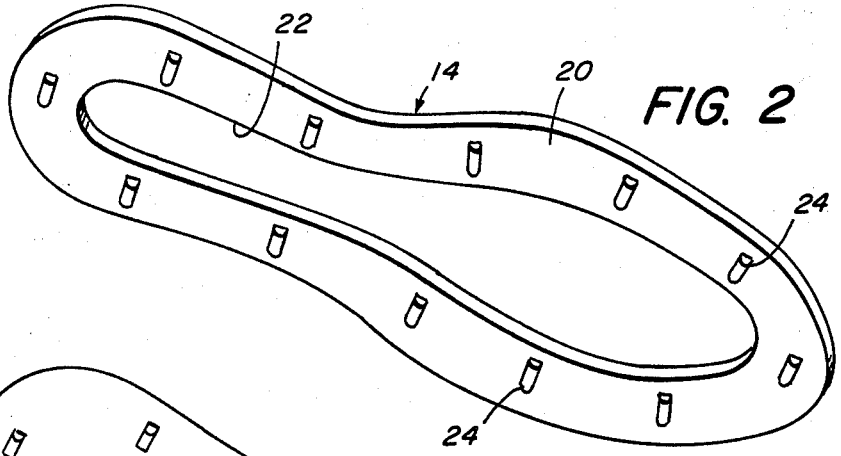
FIG. 2 is a perspective view of the bottom of an insole of this invention.

As shown in FIG. 2, insole 14 generally comprises a lip 20 surrounding a central opening 22. Opening 22 reduces the weight of the insole and increases its flexibility. However, insole 14 could be made without the opening 22. Projecting from the underside of the lip 20 are a plurality of male snaps 24. Each snap 24 is elongated with a generally domed-shaped cross-section. The snaps and the lip are molded as an integral unit to eliminate cutting and assembly operations.

Figure 4:
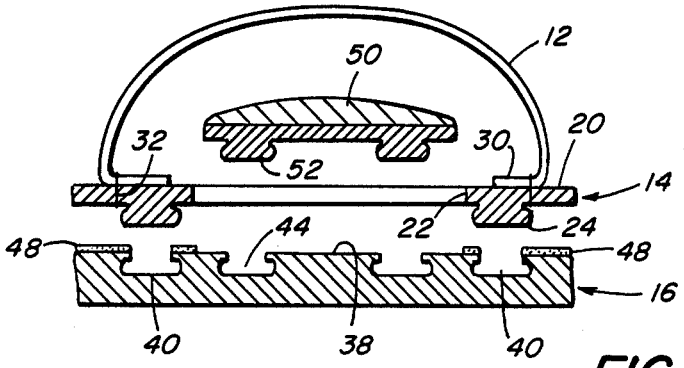
FIG. 4 is a cross-sectional view of an exploded shoe of this invention.
Figure 5:
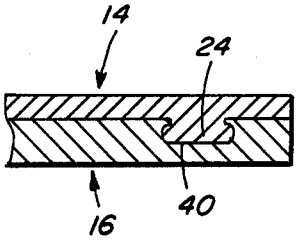
FIG. 5 is a cross-sectional view of an assembled snap structure of the preferred embodiment.

The upper 12 has its lower edge 30 folded inwardly, and the edge 30 is attached to the lip 20 by stitches 32, as shown in FIG. 4. The stitches 32 extend entirely around the edge 30 and the lip 20. Alternately, the edge 30 could be folded outwardly rather than inwardly as shown.

Figure 3:
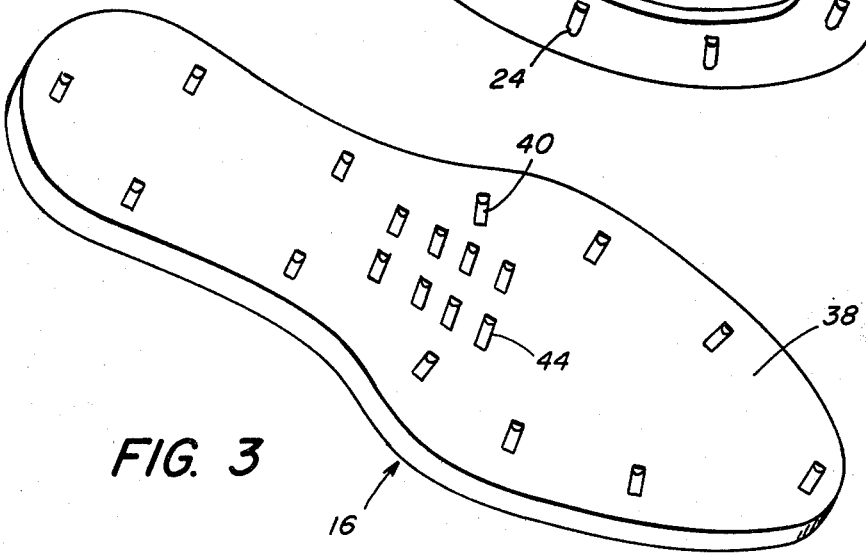
FIG. 3 is a perspective view of the top of an outsole of this invention.

As shown in FIG. 3, the outsole 16 is solid and thicker than the insole 14. The upper surface 38 of outsole 16 has a plurality of female snap indentations 40. The indentations 40 are elongated and having a generally domed-shaped cross-section. They are arranged to correspond to the male snaps 24 of the insole 14. A series of shank indentations 44 are disposed in the central portion of the upper surface 38 of outsole 16. These indentations 44 correspond to male snaps 52 on the bottom of a cushioned shank piece 50, shown in FIG. 4.

OPERATION

In assembling the shoe 10, the insole 14 and the outsole 16 are first molded in the desired shapes. The upper 12 is then attached to the insole 14 by stitches 32, and insole 14 is positioned over outsole 16 so that each insole snap 22 is aligned with an outsole indentation 40. The edge of the top surface of outsole 16 is coated with an adhesive 48, and the snaps 22 are pressed into the indentations 40, where they are held in place due to the restricted neck opening of the domed-shaped indentations 40. As the insole and the outsole have the same shape, their sidewalls combine to form a single sidewall and the tight fit of the snaps along with the cement prevents any moisture leakage between the insole and outsole.

The shoe 10 is then completed by adding the shank 50 to the inside. This is accomplished by aligning and inserting its snaps 52 with the central indentations 44 of the outsole 16. Adhesive may be used to help secure the shank 50 in place. A sock lining (not shown) may then be inserted into the shoe 10. A last (not shown) is then placed into the completed shoe 10 to preserve the proper shape, and the shoe is subjected to high temperature curing, which permanently seals the insole 14 to the outsole 16.

OTHER EMBODIMENTS

Figure 6:
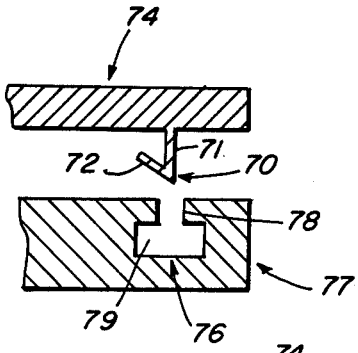
FIG. 6 is a cross-sectional view of an unassembled snap structure of another preferred embodiment.
Figure 7:
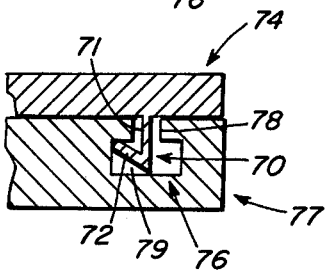
FIG. 7 is a cross-sectional view of the assembled snap structure of FIG. 6.

Other types of snap elements are also possible. As shown in FIGS. 6 and 7, a snap element 70 for an insole 74 may be a hook having a downwardly extending post 71 and a blade 72. The blade 72 projects at an angle of about 45°, and it is flexible back in the direction of the post 71 but resists flexing in the direction away from the post 71. An outsole 77 has a corresponding opening 76 having a reduced neck 78 at its top and a larger opening 79 below the neck 78. As the hook is inserted, the blade 72 flexes back towards the post 71 to allow the entire hook to pass through the narrow neck 78. Once the blade 72 is inside the larger opening 79, it flexes outwardly to its original position, and the hook cannot be removed from the opening 76. The connected snap and opening are shown in FIG. 7.

Also, it is possible to place the male snaps on the top surface outsole and the female indentations on the bottom of the insole. Further, the adhesive may be omitted, in which case the curing step can be omitted.

Other variations will occur to those skilled in the art.

What I claim is:

1. In a shoe comprising:

a first sole means, said first sole means comprising an insole having a lip surrounding a central opening, said first sole means also having a plurality of attaching members disposed on and extending from a bottom surface of said lip of said insole, each said attaching member comprising an elongated domed-shaped snap, said snaps and said insole being molded of a single piece of plastic, said lip having an upper stitched thereto, a second sole means comprising an outsole, said outsole having a plurality of receiving members in one surface, said receiving members being inverted, elongated domed-shaped openings, and a shank, said shank having a plurality of attaching members disposed on and extending from a bottom surface whereby said first sole means and said shank are fixed to said second sole means to form a completed sole by engagement of said attaching members to said receiving members.

* * * * *